United States Patent [19]

Gravley

[11] 4,361,193

[45] Nov. 30, 1982

[54] METHOD AND ARRANGEMENT FOR IMPROVING CUTTINGS REMOVAL AND REDUCING DIFFERENTIAL PRESSURE STICKING OF DRILL STRINGS IN WELLBORES

[75] Inventor: Wilton Gravley, Carrollton, Tex.

[73] Assignee: Mobil Oil Corporation, New York, N.Y.

[21] Appl. No.: 210,911

[22] Filed: Nov. 28, 1980

[51] Int. Cl.[3] ..... E21B 7/04; E21B 17/00; E21B 21/10

[52] U.S. Cl. ..... 175/61; 166/223; 175/320

[58] Field of Search ..... 175/61, 62, 65, 73, 175/320, 325, 422; 166/222, 223

[56] References Cited

U.S. PATENT DOCUMENTS

| | | | |
|---|---|---|---|
| 1,859,490 | 5/1932 | Atkinson | 175/61 |
| 2,128,352 | 8/1938 | Creighton | 175/320 X |
| 2,312,018 | 2/1943 | Beckman | 175/422 X |
| 2,805,043 | 9/1957 | Williams, Jr. | 175/324 X |
| 3,352,370 | 11/1967 | Livingston | 175/73 |
| 3,365,007 | 1/1968 | Skipper | 175/61 |
| 3,417,822 | 12/1968 | Howell | 175/320 X |
| 3,795,282 | 3/1974 | Oliver | 175/65 |
| 3,908,771 | 9/1975 | Garrett | 175/65 X |
| 4,050,529 | 9/1977 | Tagirov et al. | 175/422 |
| 4,258,801 | 3/1981 | Poston | 175/65 |

*Primary Examiner*—Stephen J. Novosad

*Attorney, Agent, or Firm*—Charles A. Huggett; Michael G. Gilman; James F. Powers, Jr.

[57] ABSTRACT

A rotary method and arrangement mitigate differential sticking of a drill string during the drilling of a wellbore and for improving cuttings removal. Tool joints are used for interconnecting joints of drill pipe together into a drill string for use in drilling the wellbore. Nozzles are provided in the tool joints or drill pipe to cause a flow of drilling fluid into the wellbore from the interior of the drill string during the drilling operation to improve removal of the cuttings from the wellbore and mitigate differential sticking of the drill string.

14 Claims, 3 Drawing Figures

METHOD AND ARRANGEMENT FOR IMPROVING CUTTINGS REMOVAL AND REDUCING DIFFERENTIAL PRESSURE STICKING OF DRILL STRINGS IN WELLBORES

BACKGROUND OF THE INVENTION

The present invention relates to a method and to an arrangement for the rotary drilling of a deviated or high-angle wellbore into the earth's crust which will mitigate the differential sticking of a drill string used to advance a drill bit at the lower end thereof, and which will improve the removal of cuttings settled in the annulus formed about the drill string in the wellbore.

A problem which is frequently encountered in the drilling of high-angle or ultrahigh angle boreholes, in effect, deviated wellbores, consists of in that the cuttings formed by the drill bit at the lower end of the drill string tend to settle on the low side of the borehole. This is particularly the case when the flow of drilling fluid or mud is stopped through the drill string while adding a joint of pipe. The cuttings become difficult to pick up by the return flow of the drilling fluid in the annulus surrounding the drill string when the flow again commences. This problem is seriously compounded because of the flow patterns of the fluid about the drill string. Thus, in a high-angle borehole, the drill string lies on the low side of the hole, and cuttings also tend to settle out on the low side, thereby causing the drill string to rotate in a so called "bed" of cuttings, seriously increasing the tendency for the drill pipe to become "differentially well stuck" or to seize in the wellbore.

Furthermore, drilling fluid velocity in the small areas on the low side of the borehole between the drill string and the hole wall is lower than in the remainder of the borehole, so that cuttings are not readily picked up and conveyed along by the return flow in the borehole.

Recent developments have enabled the drilling and completing of ultrahigh angle wells. Techniques for drilling ultrahigh angles are sometimes referred to as "extended reach drilling", a term that has been coined to describe rotary drilling operations used to drill wellbores at angles which are greater than 60° from the vertical and wherein complex wellbore profiles may be used to extend the horizontal limits of wellbores. Such techniques may be used to provide a wellbore that extends from a surface location to a subsurface location spaced at a considerable lateral distance therefrom.

Among the problems encountered in drilling deviated wells is that of the differential sticking of drill pipe. This problem also is encountered in substantially vertical wellbores but is much worse in deviated wellbores. In deviated wellbores the drill string tends to lie on the lower side of the wellbore and drill cuttings tend to settle and accumulate along the lower side of the wellbore about the drill string. This condition of having drill cuttings lying along the lower side of the wellbore about the drill string along with the usual filter cake on the wellbore wall presents conditions susceptible for differential sticking of the drill pipe, particularly when a porous formation is penetrated that has internal pressures less than the pressures existing in the borehole.

SUMMARY OF THE INVENTION

This invention is directed to alleviating the problem of differential sticking of the drill string by sweeping or circulating the drill cuttings accumulating at the lower side of the wellbore into the main stream of the drilling fluid or mud-return flow so as to improve removal of the cuttings from the wellbore.

It is a primary object of the present invention to provide a rotary method of drilling a wellbore which will reduce differential sticking of a drill string having a drill bit at the lower end thereof and which will improve the removal of cuttings tending to settle in the wellbore.

A more specific object of the invention lies in the provision of method as described hereinabove in which the drill string incorporates one or more fluid nozzles for directing a portion of the drilling fluid circulating in the drill string outwardly into the annulus of the wellbore about the drill string so as to effect "stirring" of the settled cuttings and to improve the removal of the cuttings by the return flow of the drilling fluid or mud.

Still another object of the present invention resides in the provision of one or more jet nozzle arrangements along the drill string, adopted to direct radially outwardly extending jets of drilling fluid from interiorly of the drill string into the annulus of the wellbore so as to thereby impart stirring movement to the cuttings settled therein and to improve removal of the cuttings by the return flow of the fluid in the wellbore annulus.

DESCRIPTION OF THE PREFERRED EMBODIMENTS

Figure 1:
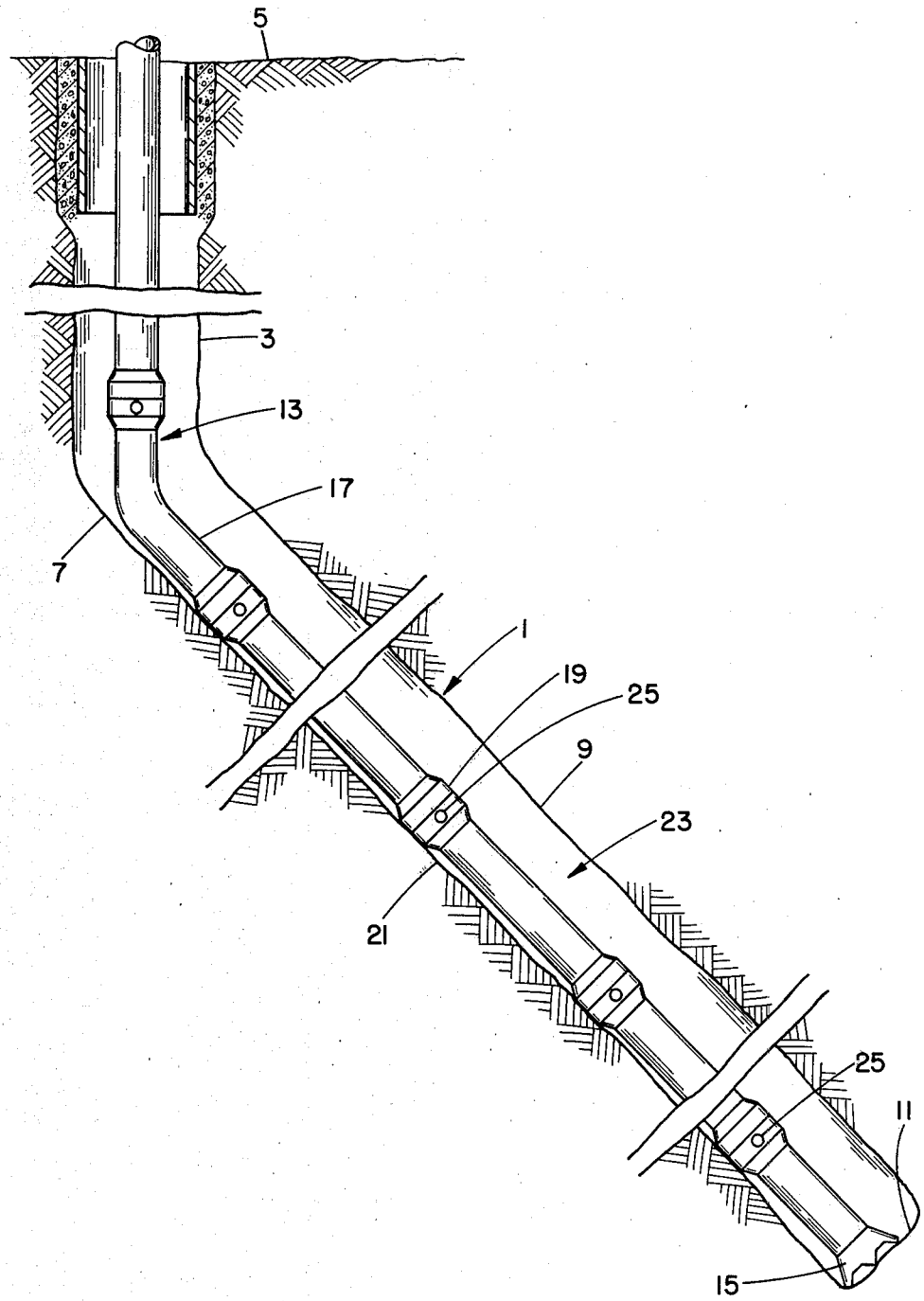
FIG. 1 is a schematic drawing of a deviated wellbore extending into the earth and illustrating the present invention.

This invention is directed to a rotary drilling technique for drilling a wellbore into the earth and is particularly applicable for drilling a deviated wellbore or an extended reach borehole into the earth.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, a drill pipe is always in tension during drilling operations. Drill pipe commonly varies from 3½" to 5" in outside diameter. Drill collars are thick-walled pipe as compared to drill pipe and thus are heavier per linear foot than drill pipe. The drill collars act as stiff members in the drill string. The drill collars are normally installed in the drill string immediately above the bit and serve to supply weight on the bit. In common rotary drilling techniques, only the bottom three-fourths of the drill collars are in axial compression to load the bit during drilling, while about the top one-fourth of the drill collars are in tension as is the drill pipe. The drill collars used in conducting rotary drilling techniques are of larger diameter than the drill pipe in use and normally are within the range of 4½" to 10" in outside diameter. The tool joints are connectors for interconnecting joints of drill pipe and are separate components that are attached to the drill pipe after its manufacture. A tool joint is comprised of a male half or pin end that is fastened to one end of an individual piece of pipe and a female half or box end is fastened to the other end. Generally, the box-end half of a tool joint is somewhat longer than the pin-end half. A complete tool joint is thus formed upon interconnecting together a box-end half and a pin-end half of a tool joint.

In carrying out rotary drilling techniques, a drilling rig is employed which utilizes a rotary table for applying torque to the top of the drill string to rotate the drill string and the bit. The rotary drill table also acts as a base stand on which all tubulars, such as drill pipe, drill collars, and casing, are suspended in the hole from the rig floor. A kelly is used as a top tubular member in the drill string and the kelly passes through the rotary table and is acted upon by the rotary table to apply the torque through the drill string to the bit. Fluid or mud pumps are used for circulating drilling fluid or mud intermediate the drilling rig and the bottom of the wellbore. Normally, the drilling fluid is pumped down the drill string and out through the drill bit and is returned to the surface through the annulus formed about the drill string. The drilling fluid serves such purposes as removing earth cuttings made by the drill bit from the wellbore, cooling the bit, and lubricating the drill string to lessen the energy required in rotating the drill pipe. In completing the well, casing is normally run thereinto and is cemented to maintain the casing in place.

As previously mentioned, in the drilling of wellbores utilizing rotary drilling equipment, problems known as differential sticking of the drill string are sometimes encountered. These problems become more severe in drilling deviated wellbores inasmuch as the drill string lies on the bottom of the deviated portion of the wellbore and drill cuttings tend to settle about the drill string. Because of the drill string and cuttings lying along the bottom of the deviated portion of the wellbore, that portion of the annulus that lies above the drill string serves as the main stream for the flow of the drilling mud and cuttings to the surface of the earth.

This invention is hereafter described in more detail by reference to the drawings. With reference to FIG. 1 there is shown a deviated wellbore 1 which may or may not have a vertical portion 3 extending from the surface 5 of the earth to a kick-off point 7 and a deviated portion 9 of the wellbore which either extends from the kick-off point or directly from the surface 5 of the earth to the wellbore bottom 11. A drill string 13, having a drill bit 15 at the lower end thereof, is shown in the wellbore 1. The drill string 13 is comprised of drill pipe 17 and the drill bit 15, and will normally include drill collars (not shown). The drill pipe 17 is constituted of joints of pipe that are interconnected together by tool joints 19. The tool joints 19 in the deviated portion 9 of the wellbore rest on the lower side 21 of the wellbore and support the drill pipe 17 above the lower side 21 of the wellbore.

In the drilling of the wellbore, drilling fluid (not shown) is circulated down the drill string 13, out the drill bit 15, and returned via the annulus 23 of the wellbore to the surface 5 of the earth. Drill cuttings formed by the breaking of the earth by the drill bit 15 are carried by the returning drilling fluid in the annulus 23 to the surface of the earth. These drill cuttings (not shown) tend to settle along the lower side 21 of the wellbore about the drill pipe 17. The tool joints 19 rest on the lower side 21 of the wellbore and support the drill pipe 17 above most of these cuttings.

At least some of the drill pipe 17 or, preferably tool joints 19 are provided with nozzle units 25 spaced along the drill string 13 in at least the deviated portion of the wellbore. The nozzle units 25, which are described in greater detail hereinbelow in connection with FIGS. 2 and 3 of the drawings, facilitate the radially outward flow in the form of fluid jets of at least a portion of the drilling fluid or mud circulated in the drill string 13 into the annulus 23 so as to impart "stirring" or circulatory motion to any cuttings which may have settled along the lower side 21 of the wellbore. This, in effect, will improve removal of the cuttings by the upward return flow of the fluid flowing in the annulus 23 and extensively aid in reducing any differential pressure sticking of the drill string.

Figure 2:
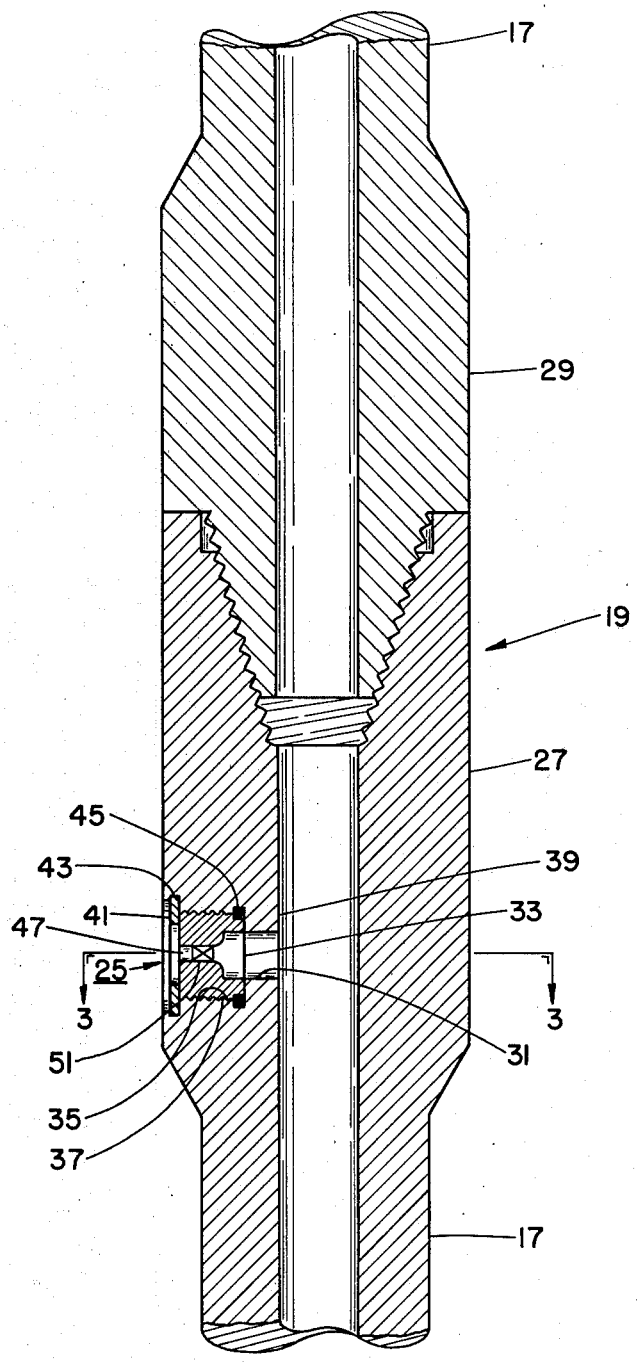
FIG. 2 is a longitudinal sectional drawing illustrating the tool joint between two drill pipes, on an enlarged scale which incorporates the nozzle arrangement of the invention.

Referring now specifically to FIG. 2 of the drawings, there is illustrated, in an enlarged longitudinal section, a tool joint 19 of the drill string 13 which, in the usual manner, consists of a tool joint-box 27 at the upper end of a section of drill pipe 17, and of a tool joint-pin 29 at the lower end of a section of drill pipe located thereabove. The box 27 and pin 29 are threaded together to form the complete tool joint.

As shown in this embodiment, a nozzle unit 25 is positioned in the tool joint-box 27 within a radial through opening 31 formed in the box wall. The nozzle unit 25 includes a hollow bushing member 33 having an external threaded circumference 35 which engages with an internal thread 37 formed in the opening 31. An annular shoulder 39 of reduced diameter formed at the inner end of opening 31 acts as a stop when the bushing member is threaded into place within the opening 31. In order to prevent the bushing member 33 from working itself out of the opening 31, a locking or retainer ring 41 may engage within an annular groove 43 formed in the tool joint-box opening 31 at the end of the bushing member 33 remote from the shoulder 39. A fluid seal or gasket 45 encompasses the bushing member 33 proximate one end thereof so as to prevent leakage of fluid between the interengaged threaded surfaces 35 and 37.

The hollow bushing member 33 is provided with a discharge orifice 47 which communicates between the interior of the drill pipe 17 and the annulus 23 of the wellbore. Preferably, the discharge orifice should have an opening diameter in the range of about 1/16 to $\frac{1}{4}$ inches as to allow for the flow therethrough of a thin high-velocity jet of drilling fluid or mud from the interior of the drill pipe 17.

Figure 3:
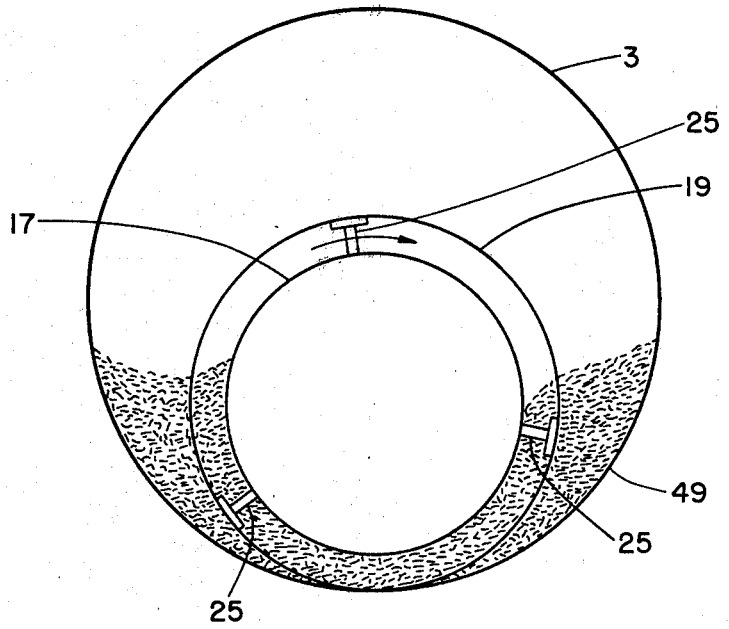
FIG. 3 shows a schematic cross-sectional view of drill pipe taken along line 3—3 in FIG. 2 and illustrating the wellbore-cleaning effects of the present invention.

As is shown in FIG. 3 of the drawings, three nozzle units 25 may be equidistantly spaced at 120° intervals about the circumference of the tool joint-box 27 so as to ensure that irrespective of the angular position of the drill string 13 upon ceasing of rotation when another joint of pipe is added, that at least one nozzle unit 25 will be in a position to direct a jet of fluid towards the lower side 21 of the wellbore. This will ensure "stirring" or circulation of the drill cuttings 49 which have agglomerated in the lower portion of the annulus 23, thereby rendering easier the removal of these cuttings by the upward return flow of drilling liquid or mud.

Although three nozzle units 25 have been shown in FIG. 3, it is readily apparent that only one, two or even more nozzle units may be employed at any specific level along the wellbore. Furthermore, nozzle units may be provided along the drill string 13 as desired, and may be located not only at the tool joints, but along the length of the drill pipe itself.

In a modified embodiment of the invention, the nozzle units 25 may each incorporate a suitable pressure drop-actuated check valve 51, shown schematically in FIG. 2, which would cause the nozzle to close when fluid flow rates reach a predetermined value and the nozzle action is not required at that point in operation.

What is claimed is:

1. A method of rotary drilling a deviated wellbore into the earth's crust to mitigate differential sticking of a drill string, formed of a plurality of sections of drill pipe interconnected at tool joints and having a drill bit at the lower end thereof, and to improve the removal of cuttings settled in the lower portion of the annulus formed about the drill string in said deviated wellbore, comprising:

a. circulating a drilling fluid down the drill string and returning said fluid from the wellbore in a return stream in the annulus formed about the drill string;

b. sweeping the drill cuttings accumulated on the lower side of the deviated wellbore into the main return stream of the drilling fluid flow by projecting at least a portion of said drilling fluid substantially radially outwardly as fluid jets from at least one of the tool joints of said drill string into said wellbore annulus from the interior of said drill string so as to impart stirring movement to cuttings settled on the low side of said wellbore and facilitate removal thereof by the upwardly flowing fluid in said annulus.

2. A method as claimed in claim 1, said step of projecting including the step of projecting a plurality of fluid jets at a tool joint which are circumferentially spaced around the circumference of the tool joint.

3. A method as claimed in claim 2, said step of projecting including the step of projecting at least three fluid jets at a tool joint which are substantially evenly circumferentially spaced around the circumference of the tool joint.

4. A method as claimed in claim 1 or 2 or 3, said step of projecting including the step of projecting at a plurality of adjacent tool joints in the deviated wellbore.

5. A method as claimed in claim 1, said fluid jets being projected radially outwardly from the tool joint box portion of said tool joints.

6. A method as claimed in claim 1, comprising mounting nozzle means in said drill string to form said jets of outwardly directed drilling fluid into the annulus of said wellbore.

7. An arrangement for the rotary drilling of a deviated wellbore into the earth's crust which mitigates differential sticking of a drill string, comprised of a plurality of sections of drill pipe interconnected at tool joints and having a drill bit at the lower end thereof, and to improve the removal of cuttings settled in the lower portion of the annulus formed about said drill string in said deviated wellbore, comprising means for circulating a drilling fluid down the center of the drill string such that the fluid is returned from the wellbore in a return stream in the annulus formed about the drill string, means for sweeping the drill cuttings accumulated on the lower side of the deviated wellbore into the main return stream of the drilling fluid flow in the annulus formed about the drill string, including nozzle means provided in said drill string in at least one of the tool joints of said drill string and communicating the interior of said drill string with said annulus whereby a portion of drilling fluid circulated down the drill string is projected as fluid jets by said nozzle means into said wellbore annulus to impart stirring movement to cuttings settled on the low side of said wellbore and facilitate removal thereof by the upwardly flowing fluid in said annulus.

8. An arrangement as claimed in claim 7, each tool joint having a diameter which is larger in diameter than the nominal diameter of the drill string, such that the tool joints rest on the lower side of the deviated wellbore and support the main portion of the drill string above the cuttings.

9. An arrangement as claimed in claim 7 or 8, said nozzle means including a plurality of nozzles at a tool joint which are circumferentially spaced around the circumference of the tool joint.

10. An arrangement as claimed in claim 9, said nozzle means including at least three nozzles at a tool joint which are substantially evenly circumferentially spaced around the circumference of the tool joint.

11. An arrangement as claimed in claim 9, said nozzle means including nozzles provided at a plurality of adjacent tool joints in the deviated wellbore.

12. An arrangement as claimed in claim 7, said nozzle means being located in the tool joint box portion of said tool joints.

13. An arrangement as claimed in claim 7, comprising a check valve in each said nozzle means for closing said nozzle means upon the flow of said drilling fluid in said drill string reaching a predetermined flow volume.

14. An arrangement as claimed in claim 13, said check valve being responsive to a pressure drop in said drill string for closing said nozzle means.

* * * * *